US007811015B2

(12) United States Patent
Yanagi et al.

(10) Patent No.: US 7,811,015 B2
(45) Date of Patent: Oct. 12, 2010

(54) PRINTING APPARATUS AND CONVEYANCE CONTROL METHOD

(75) Inventors: Haruyuki Yanagi, Machida (JP); Kentaro Onuma, Yokohama (JP); Tetsuya Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 517 days.

(21) Appl. No.: 11/842,532

(22) Filed: Aug. 21, 2007

(65) Prior Publication Data

US 2008/0050164 A1 Feb. 28, 2008

(30) Foreign Application Priority Data

Aug. 23, 2006 (JP) ..... 2006-227015

(51) Int. Cl.
*B41J 13/03* (2006.01)
*B41J 13/00* (2006.01)
*B65H 43/00* (2006.01)

(52) U.S. Cl. ..... 400/76; 400/578; 400/582; 347/104

(58) Field of Classification Search ..... 400/582
See application file for complete search history.

(56) References Cited

U.S. PATENT DOCUMENTS

| | | | | |
|---|---|---|---|---|
| 5,602,571 | A | 2/1997 | Suda et al. | |
| 6,095,703 | A | 8/2000 | Tanaka et al. | |
| 6,168,333 | B1 | 1/2001 | Merz et al. | 400/634 |
| 6,655,865 | B2 | 12/2003 | Yanagi et al. | 400/705 |
| 6,685,370 | B2 | 2/2004 | Hiramatsu | |
| 6,761,425 | B2 | 7/2004 | Kawaguchi | 347/16 |
| 7,014,378 | B2 | 3/2006 | Saito et al. | 400/582 |
| 7,021,737 | B2 | 4/2006 | Yamada | |
| 7,093,971 | B2 | 8/2006 | Yu | 347/19 |
| 7,195,239 | B2 | 3/2007 | Saito et al. | 271/256 |
| 7,290,763 | B2 | 11/2007 | Suzuki et al. | |
| 7,367,733 | B2 | 5/2008 | Bedzyk et al. | |
| 7,401,913 | B2 | 7/2008 | Nishiberi et al. | |
| 7,410,167 | B2 * | 8/2008 | Koga et al. | 271/266 |

(Continued)

FOREIGN PATENT DOCUMENTS

CN 1060432 4/1992

(Continued)

OTHER PUBLICATIONS

Official Letter/Search Report issued by the European Patent Office, on Nov. 11, 2007, in European Patent Application No. 07016478.5.

(Continued)

*Primary Examiner*—Daniel J Colilla
(74) *Attorney, Agent, or Firm*—Fitzpatrick, Cella, Harper & Scinto

(57) ABSTRACT

This invention relates to a printing apparatus and a conveyance control method capable of simultaneously operating plural encoder sensors and executing more accurate printing medium conveyance control. A first encoder sensor provided adjacent to a first conveyance roller detects the conveyance amount of a printing medium by the first conveyance roller provided in the conveyance path of the printing medium. A second encoder sensor provided adjacent to a second conveyance roller detects the conveyance amount of the printing medium by the second conveyance roller provided in the conveyance path of the printing medium at the downstream side from the first conveyance roller in the conveyance direction of the printing medium. For example, conveyance of the printing medium is controlled on the basis of the output signals from the first and second encoder sensors when a tail end of the printing medium is located adjacent to the first conveyance roller.

7 Claims, 10 Drawing Sheets

U.S. PATENT DOCUMENTS

| | | | | |
|---|---|---|---|---|
| 7,597,322 | B2 | 10/2009 | Suzuki et al. | |
| 2001/0055054 | A1* | 12/2001 | Kosaka et al. | 347/104 |
| 2005/0163553 | A1* | 7/2005 | Cercos et al. | 400/636 |
| 2006/0033943 | A1 | 2/2006 | Yanagi | 358/1.13 |
| 2007/0007711 | A1 | 1/2007 | Suzuki et al. | |
| 2008/0006984 | A1 | 1/2008 | Kakishima | |
| 2008/0008513 | A1 | 1/2008 | Kakishima et al. | |
| 2008/0048382 | A1 | 2/2008 | Suzuki et al. | 271/4.02 |
| 2008/0049089 | A1 | 2/2008 | Ishikawa et al. | 347/104 |
| 2008/0050165 | A1 | 2/2008 | Saito et al. | 400/582 |

FOREIGN PATENT DOCUMENTS

| | | | | |
|---|---|---|---|---|
| CN | 1496854 | | | 5/2004 |
| EP | 1 666 263 | A1 | | 6/2006 |
| JP | 08142431 | A | * | 6/1996 |
| JP | 2002-225370 | | | 8/2002 |
| JP | 2002-254736 | | | 9/2002 |
| JP | 2002361958 | A | * | 12/2002 |
| JP | 2004-122362 | | | 4/2004 |
| JP | 2005-132028 | | | 5/2005 |
| JP | 2005131928 | A | * | 5/2005 |
| JP | 2006-82425 | | | 3/2006 |
| JP | 2006-170745 | | | 6/2006 |

OTHER PUBLICATIONS

Official Action (Translation), dated May 8, 2009, issued by The Chinese Patent Office, in Chinese Patent Application No. 200710146593.2.

* cited by examiner

PRINTING APPARATUS AND CONVEYANCE CONTROL METHOD

BACKGROUND OF THE INVENTION

1. Field of the Invention

The present invention relates to a printing apparatus and a conveyance control method. Particularly, the present invention relates to a printing apparatus and a conveyance control method which perform accurate conveyance control even when, e.g., the leading edge or trailing edge of a printing medium enters between or passes through conveyance rollers.

2. Description of the Related Art

Recent printing apparatuses such as printers use not only plain paper but also printing media such as photo special paper to print photo images in many occasions. In particular, an inkjet printer which uses smaller ink droplets for printing can obtain an image quality equal to or higher than a film photo.

Accordingly, conveyance of printing media is also required to be accurate. Conveyance rollers use precision rollers with, e.g., a grindstone coating on a metal shaft. A DC motor used to drive the conveyance rollers is controlled by a cord wheel and an encoder sensor provided coaxially, thereby simultaneously ensuring high accuracy and high-speed conveyance.

Only one pair of conveyance rollers does not suffice for accurate printing of an image up to the trailing edge of a printing medium. To implement, e.g., marginless print, some proposed arrangements have another pair of conveyance rollers downstream in the printing medium conveyance direction. In such an arrangement, however, when the tail end of a printing medium passes through a conveyance roller pair upstream in the conveyance direction, the conveyance amount may change, resulting in density unevenness in the image. To ensure conveyance accuracy up to the tail end of a printing medium, the nozzles of the printhead to be used are restricted, or printing medium conveyance is controlled in addition to the use nozzle restriction during printing on the tail end part of a printing medium, thereby maintain the printing quality (see Japanese Patent Publication Laid-Open No. 2002-254736). The mechanical accuracy of the conveyance roller pair downstream in the conveyance direction is also raised to ensure the conveyance accuracy.

In recent years, the requirements for a higher printed image quality and a higher printing speed keeps growing. To meet these requirement and attain higher image quality, ink droplets to be used in printing are becoming smaller. This also indicates that it is necessary to more accurately convey a printing medium.

For this purpose, preferably, a cord wheel is axially provided not only on the upstream precision conveyance roller but also on the downstream conveyance roller, and dedicated encoder sensors are used such that a plurality of encoder sensors control the upstream and downstream roller positions, respectively.

However, employment of such a double encoder configuration makes it difficult to accurately control conveyance when the tail end of the printing medium has passed through the upstream conveyance roller, or the front end of the printing medium has reached the downstream conveyance roller. Accurate conveyance control is also impossible even when the tail end of the printing medium is just going to pass through the upstream conveyance roller. For example, if the tail end of a printing medium is located closest to the nip of the upstream conveyance roller pair, the printing medium may be fed by an amount corresponding to the backlash of a series of drive gears to the downstream discharge roller. In this case, the print position may shift by an amount equal to the conveyance amount, resulting in poor quality of a printed image.

SUMMARY OF THE INVENTION

Accordingly, the present invention is conceived as a response to the above-described disadvantages of the conventional art.

For example, a printing apparatus and a conveyance control method according to this invention are capable of simultaneously operating a plurality of encoder sensors and performing more accurate printing medium conveyance control.

According to one aspect of the present invention, preferably, there is provided a printing apparatus which includes conveyance means for conveying a printing medium, and scanning means for reciprocally moving a printhead in a direction different from a conveyance direction by the conveyance means, and causes the printhead to print on the printing medium, the apparatus comprising: a first conveyance roller, provided in a conveyance path of the conveyance means, for conveying the printing medium; a second conveyance roller, provided in the conveyance path of the conveyance means at a downstream side from the first conveyance roller with respect to the conveyance direction of the printing medium, for conveying the printing medium; a first encoder sensor, provided adjacent to the first conveyance roller, for detecting a conveyance amount by the first conveyance roller; a second encoder sensor, provided adjacent to the second conveyance roller, for detecting a conveyance amount by the second conveyance roller; detection means for detecting a tail end of the printing medium with respect to the conveyance direction of the printing medium; and conveyance control means for controlling conveyance of the printing medium on the basis of output signals from the first encoder sensor and the second encoder sensor in a case where the tail end of the printing is located adjacent to the first conveyance roller, wherein the conveyance control means includes: comparison means for comparing a conveyance amount obtained on the basis of the output signal from the first encoder sensor with a conveyance amount obtained on the basis of the output signal from the second encoder sensor; and correction means for correcting conveyance of the printing medium by rotating the second conveyance roller in a reverse direction on the basis of a comparison result from the comparison means.

According to another aspect of the present invention, preferably, there is provided a conveyance control method having the same feature as the above printing apparatus.

According to still another aspect of the present invention, preferably, there is provided a printing apparatus which includes conveyance means for conveying a printing medium, and scanning means for reciprocally moving a printhead in a direction different from a conveyance direction by the conveyance means, and causes the printhead to print on the printing medium, the apparatus comprising: a first conveyance roller, provided in a conveyance path of the conveyance means, for conveying the printing medium; a second conveyance roller, provided in the conveyance path of the conveyance means at a downstream side from the first conveyance roller with respect to the conveyance direction of the printing medium, for conveying the printing medium; a first encoder sensor, provided adjacent to the first conveyance roller, for detecting a conveyance amount by the first conveyance roller; a second encoder sensor, provided adjacent to the second conveyance roller, for detecting a conveyance amount by the second conveyance roller; detection means for detecting a front end of the printing medium with respect to the conveyance direction of the printing medium; and conveyance control means for controlling conveyance of the printing medium on the basis of output signals from the first encoder sensor and the second encoder sensor in a case where the front end of the printing is located adjacent to the second conveyance roller, wherein the conveyance control means includes: comparison means for comparing a conveyance amount obtained on the basis of the output signal from the first encoder sensor with a conveyance amount obtained on the basis of the output signal from the second encoder sensor; and correction means for correcting conveyance of the printing medium by rotating the first conveyance roller and the second conveyance roller in a reverse direction on the basis of a comparison result from the comparison means.

According to still another aspect of the present invention, preferably, there is provided a conveyance control method having the same feature as the above printing apparatus.

According to still another aspect of the present invention, preferably, there is provided a printing apparatus using a printhead to print on a printing medium, comprising: a first conveyance roller for conveying the printing medium; a second conveyance roller, provided at a downstream side from the first conveyance roller with respect to a conveyance direction of the printing medium, for conveying the printing medium; a first encoder for outputting a signal according to rotation of the first conveyance roller; a second encoder for outputting a signal according to rotation of the second conveyance roller; and conveyance control means for controlling conveyance of the printing medium on the basis of first information obtained from the signal output from the first encoder, second information obtained from the signal output from the second encoder, and a position of the printing medium on a conveyance path, wherein the conveyance control means performs conveyance control such that the printing medium is conveyed toward an upstream side of the conveyance direction of the printing medium, based on the first and second information obtained when a tail end of the printing medium has just passed through the first conveyance roller.

According to still another aspect of the present invention, preferably, there is provided a conveyance control method having the same feature as the above printing apparatus.

According to another aspect of the present invention, preferably, there is provided.

The invention is particularly advantageous since the state of a printing medium is estimated by selectively using outputs from a plurality of encoder sensors in accordance with the position of the printing medium on the conveyance path so that optimum conveyance control can be performed. This results in printing an image with higher quality.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
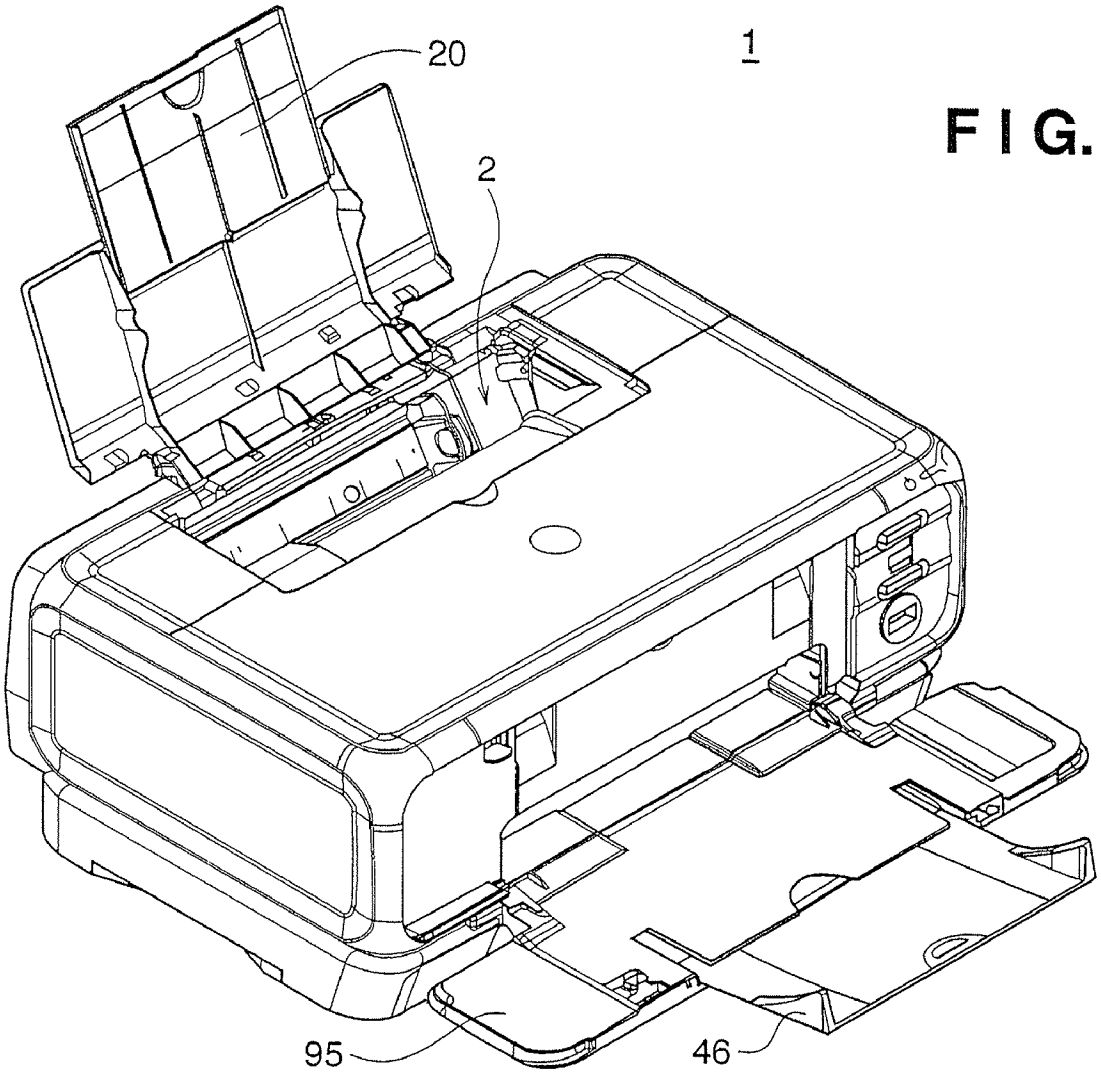
FIG. 1 is a schematic perspective view of a printing apparatus of a typical embodiment of the present invention, which prints by using an inkjet printhead.

FIG. 1 is a schematic perspective view of a printing apparatus of a typical embodiment of the present invention, which prints using an inkjet printhead.

Figure 2:
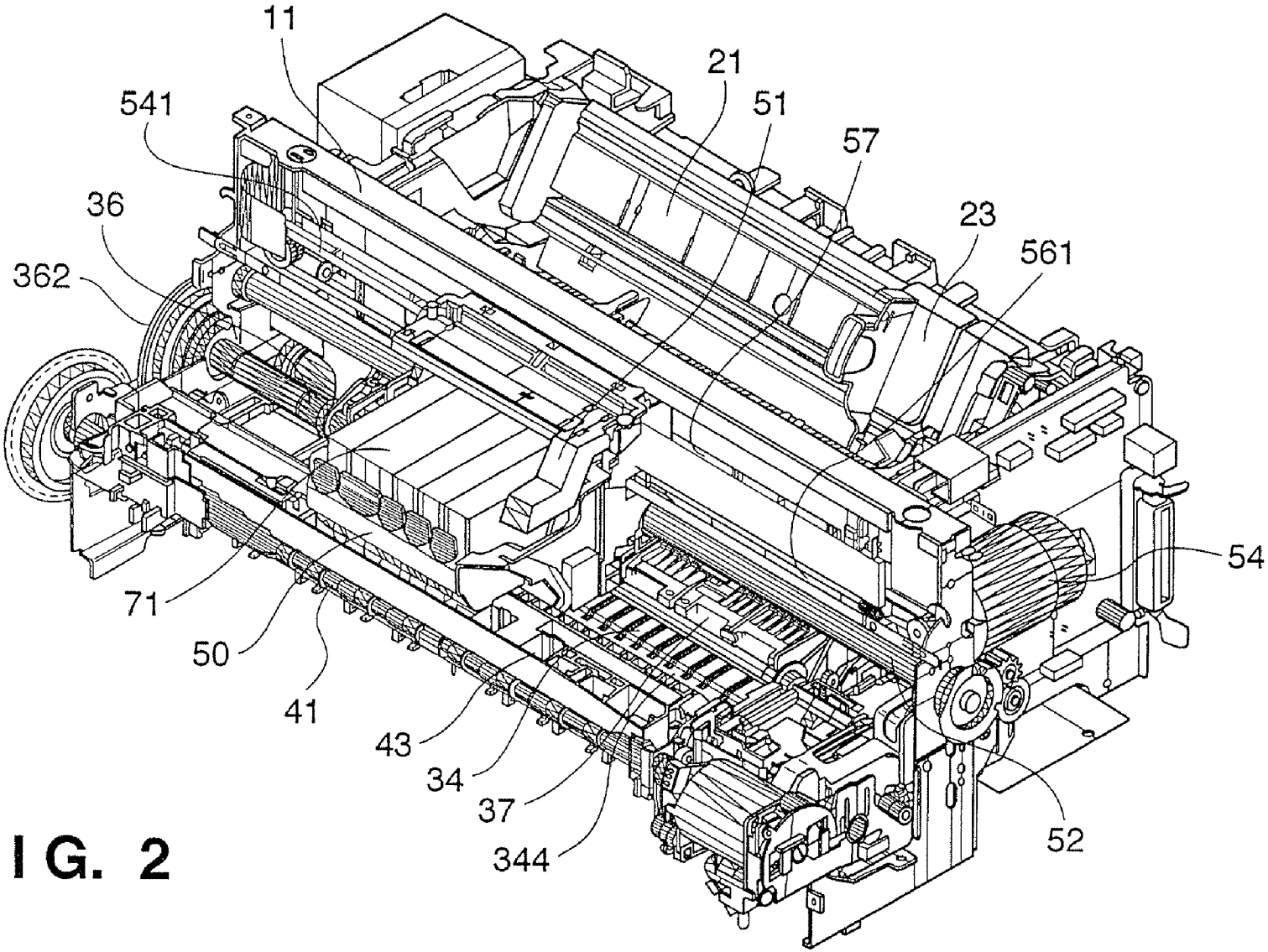
FIG. 2 is a schematic perspective view showing the internal structure of the printing apparatus in FIG. 1 without the outer case.

FIG. 2 is a schematic perspective view showing the internal structure of the printing apparatus in FIG. 1 without the outer case. For example, the printing apparatus forms an image on a printing medium by repeatedly conveying the printing medium by a predetermined amount and scanning a carriage with a printhead.

Figure 3:
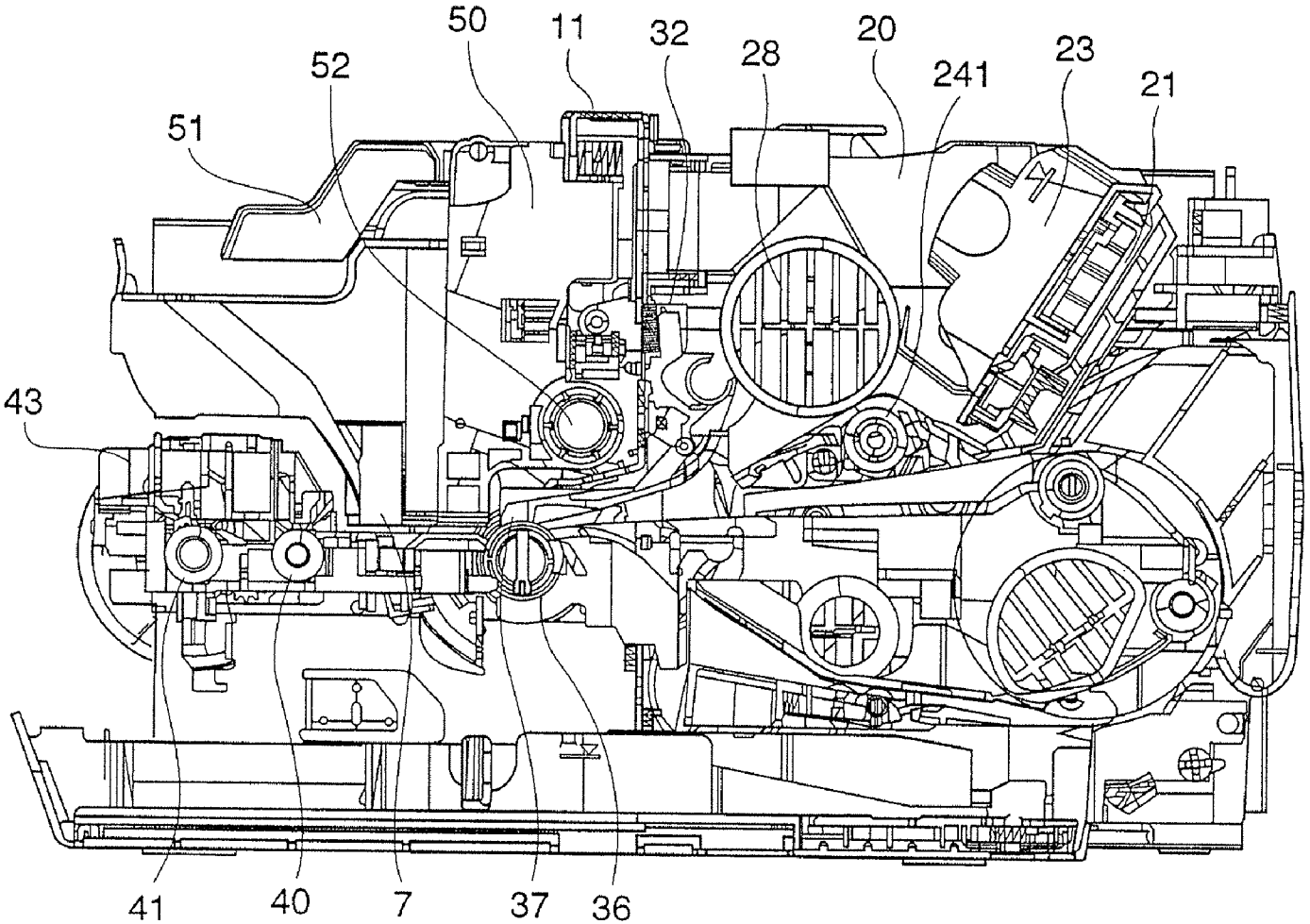
FIG. 3 is a side sectional view showing a printing medium conveyance mechanism in the internal structure of the printing apparatus in FIG. 2.

FIG. 3 is a side sectional view showing a printing medium conveyance mechanism in the internal structure of the printing apparatus in FIG. 2.

Figure 4:
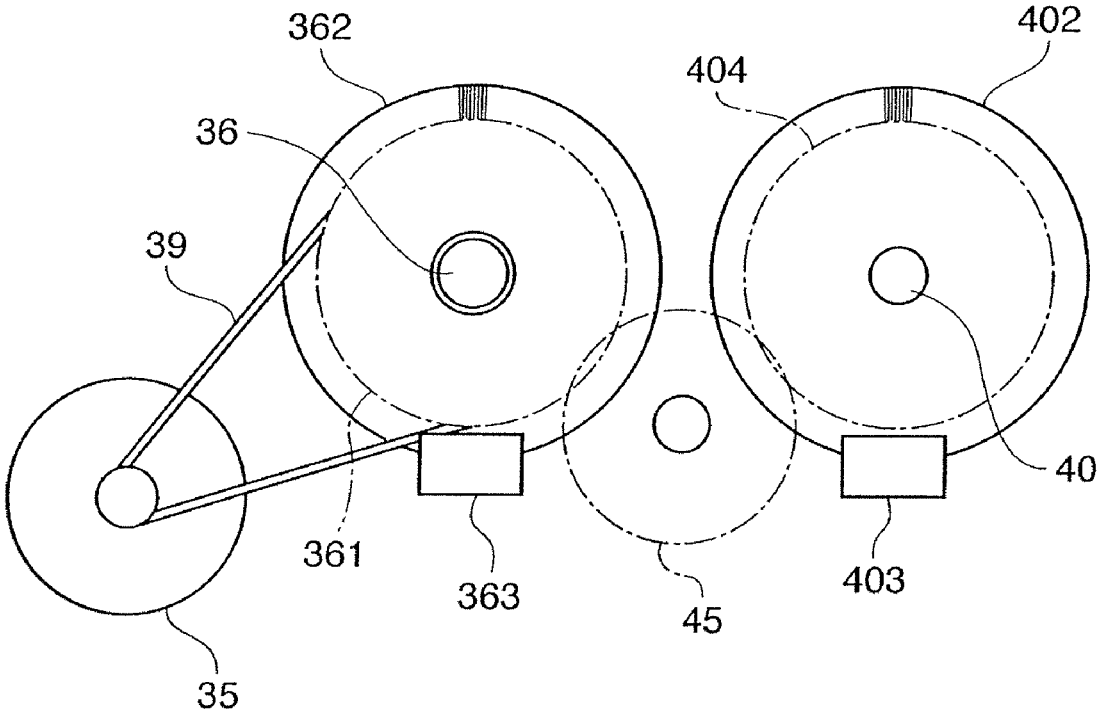
FIG. 4 is a side sectional view showing a conveyance roller and a discharge roller which are included in the printing medium conveyance mechanism and have encoders, respectively.

FIG. 4 is a side sectional view showing a conveyance roller and a discharge roller which are included in the printing medium conveyance mechanism and have encoders, respectively.

The arrangement of the printing apparatus will be described next with reference to FIGS. 1 to 4.

A printing apparatus 1 shown in FIGS. 1 to 4 includes a feeding portion, conveyance portion, carriage portion, and discharge portion. The schematic arrangements of these portions will be described sequentially.

(A) Feeding Portion

A feeding portion 2 shown in FIG. 1 is designed to stack sheet-like printing media (not shown) such as cut sheets on a pressure plate 21, as shown in FIG. 3. In the feeding portion 2, the pressure plate 21, a feed roller 28 to feed a printing medium, and a separation roller 241 to separate each printing medium are attached to a base 20.

A feed tray (not shown) to hold the stacked printing media is attached to the base 20 or housing. The slidably retractable feed tray is pulled out for use.

The feed roller 28 is columnar and has an arc-shaped section. A motor shared by a cleaning unit provided in the feeding portion 2 transmits a driving force to the feed roller 28 via a driving transmitting gear (not shown) and a planet gear (not shown).

A movable side guide 23 is provided on the pressure plate 21 to limit the stack position of printing media. The pressure plate 21 can rotate about a rotating shaft coupled to the base 20. A platen spring (not shown) biases the pressure plate 21 to the feed roller 28. The pressure plate 21 has, on its part facing the feed roller 28, a separation sheet (not shown) made of a material with a large friction coefficient, e.g., artificial leather to prevent erroneous multiple sheets conveyance when the stacked printing media are going to run out. The pressure plate 21 can abut against the feed roller 28 or separate from it via a pressure plate cam (not shown).

The separation roller 241 has a clutch spring (not shown). With a predetermined load or more, the attachment portion of the separation roller 241 can rotate.

In a normal standby state, the stack port is closed not to feed the stacked printing media into the printing apparatus. When feeding starts in this state, the motor is driven to make the separation roller 241 abut against the feed roller 28. The pressure plate 21 also abuts against the feed roller 28. Feeding of the printing media starts in this state. Only a predetermined number of printing media are fed to a nip portion formed by the feed roller 28 and the separation roller 241. The fed printing media are separated at the nip portion. Only the printing medium at the top is fed into the printing apparatus.

When the printing medium reaches a conveyance roller 36 and pinch rollers 37, the pressure plate cam (not shown) returns the pressure plate 21 to the initial position. At this time, the printing medium that has reached the nip portion formed by the feed roller 28 and the separation roller 241 can return to the stack position.

(B) Conveyance Portion

The conveyance portion is attached to a chassis 11 made of a bent metal sheet. The conveyance portion has the conveyance roller 36 for conveying a printing medium, and a PE sensor 32. The conveyance roller 36 is made of a metal shaft with a coating of ceramic micro-particles. The conveyance roller 36 is received by bearings at its metal parts of both ends and attached to the chassis 11. A conveyance roller tension spring (not shown) is inserted between the conveyance roller 36 and each bearing to bias the conveyance roller 36 and apply a predetermined load to it during rotation so that stable conveyance is possible.

The plurality of pinch rollers 37 are abut against and follow the conveyance roller 36. A pinch roller holder (not shown) holds the pinch rollers 37. A pinch roller spring (not shown) biases the pinch rollers 37 to press them against the conveyance roller 36 so that a printing medium conveyance force is generated. The pinch rollers 37 rotate about the rotating shaft of the pinch roller holder, which is attached to the bearings of the chassis 11. A platen 34 is disposed at the entrance of the conveyance portion where a printing medium arrives. The platen 34 is attached to the chassis 11 and positioned.

In the above arrangement, a printing medium fed to the conveyance portion is guided by the pinch roller holder (not shown) and a paper guide flapper and fed to the roller pair of the conveyance roller 36 and pinch rollers 37. At this time, the PE sensor 32 detects the leading edge of the conveyed printing medium whereby the print position of the printing medium is determined. As a conveyance motor (not shown) rotates the pair of rollers 36 and 37, the printing medium is conveyed on the platen 34. Ribs serving as a conveyance reference plane are formed on the platen 34 to manage the gap to the printhead and suppress wave of the printing medium together with the discharge portion to be described later.

As shown in FIG. 4, a conveyance motor 35 formed from a DC motor transmits its rotating force to a pulley 361 provided coaxially on the conveyance roller 36 via a timing belt 39, thereby driving the conveyance roller 36. A cord wheel 362 with markings formed at a pitch of 150 to 300 lpi is provided coaxially on the conveyance roller 36 to detect the conveyance amount by the conveyance roller 36. An encoder sensor 363 to read the markings is attached to the chassis 11 to be adjacent to the cord wheel 362.

A printhead 7 used for forming an image on the basis of image information is provided downstream in the printing medium conveyance direction of the conveyance roller 36.

As the printhead 7, an inkjet printhead including color ink tanks 71 that are individually exchangeable is used. The printhead 7 discharges ink from nozzles to form an image on a printing medium as the ink film-boils upon receiving heat from, e.g., a heater and creates bubbles which grow or shrink to change the pressure. At this time, the platen 34 holds the printing medium to maintain a predetermined distance between its print surface and the nozzles.

An absorbent material 344 is provided on the platen 34 to absorb ink overflowing from the edge of a printing medium in full print (marginless print). The absorbent material 344 absorbs ink overflowing from all four edges of a printing medium.

(C) Carriage Portion

A carriage portion 5 has a carriage 50 to which the printhead 7 is attached. A guide shaft 52 that reciprocally scans in a perpendicular direction (different direction) to the printing medium conveyance direction and a guide rail (not shown) which holds the rear end of the carriage 50 to maintain the gap between the printhead 7 and a printing medium support the carriage 50. The guide shaft 52 is attached to the chassis 11. The guide rail is integrated with the chassis 11.

A carriage motor 54 attached to the chassis 11 drives the carriage 50 via a timing belt 541. The timing belt 541 connects to the carriage 50 via a damper made of, e.g., rubber and reduces the density unevenness in images by attenuating vibrations of the carriage motor 54 and the like. A cord strip 561 with markings formed at a pitch of 150 to 300 lpi is provided parallel to the timing belt 541 to detect the position of the carriage 50. An encoder sensor (not shown) to read the markings is provided on a carriage substrate (not shown) provided in the carriage 50. The carriage 50 also has a flexible substrate 57 to transmit various kinds of control signals and print signals from a control circuit (to be described later) to the printhead 7.

A head set lever 51 is provided to fix the printhead 7 to the carriage 50. The printhead 7 is fixed to the carriage 50 by turning the head set lever 51 about its fulcrum.

To form an image on a printing medium, the pair of rollers 36 and 37 convey a printing medium to the ink discharge position of the printhead 7 along the printing medium conveyance direction. Simultaneously, the carriage motor 54 moves the carriage 50 to the ink discharge position along the carriage moving direction. The printhead 7 discharges ink to the printing medium in accordance with a control signal from the control circuit, thereby forming an image.

(D) Discharge Portion

The discharge portion includes two discharge rollers 40 and 41, a spur (not shown) that abuts against the discharge rollers 40 and 41 at a predetermined pressure and rotates with them, and a series of gears to transmit the driving force of the conveyance roller to the discharge rollers 40 and 41. The discharge rollers 40 and 41 are attached to the platen 34. The discharge roller 40 has a plurality of rubber parts on its metal shaft.

As shown in FIG. 4, the discharge roller 40 is driven as the drive of the conveyance roller 36 acts, via an idler gear 45, on a discharge roller gear 404 directly connected to the discharge roller 40. The discharge roller 41 provided downstream of the discharge roller 40 in the printing medium conveyance direction is made of a resin. Driving force to the discharge roller 41 is transmitted from the discharge roller 40 via another idler gear. A cord wheel 402 with markings formed at a pitch of 150 to 300 lpi is provided coaxially on the discharge roller 40 to detect the conveyance amount by the discharge roller 40. An encoder sensor 403 to read the markings is attached to the chassis 11 to be adjacent to the cord wheel 402.

The spur is attached to a spur holder 43.

With the above-described arrangement, the printing medium printed by the printhead 7 is pinched at the nip between the spur and the discharge roller 41, conveyed, and discharged to a discharge tray 46. The discharge tray 46 is retractable into a front cover 95. For use, the discharge tray 46 is pulled out. The discharge tray 46 has an ascending slope and vertical projections at two ends to easily stack discharged printing media and prevent friction of printed surfaces.

Figure 5:
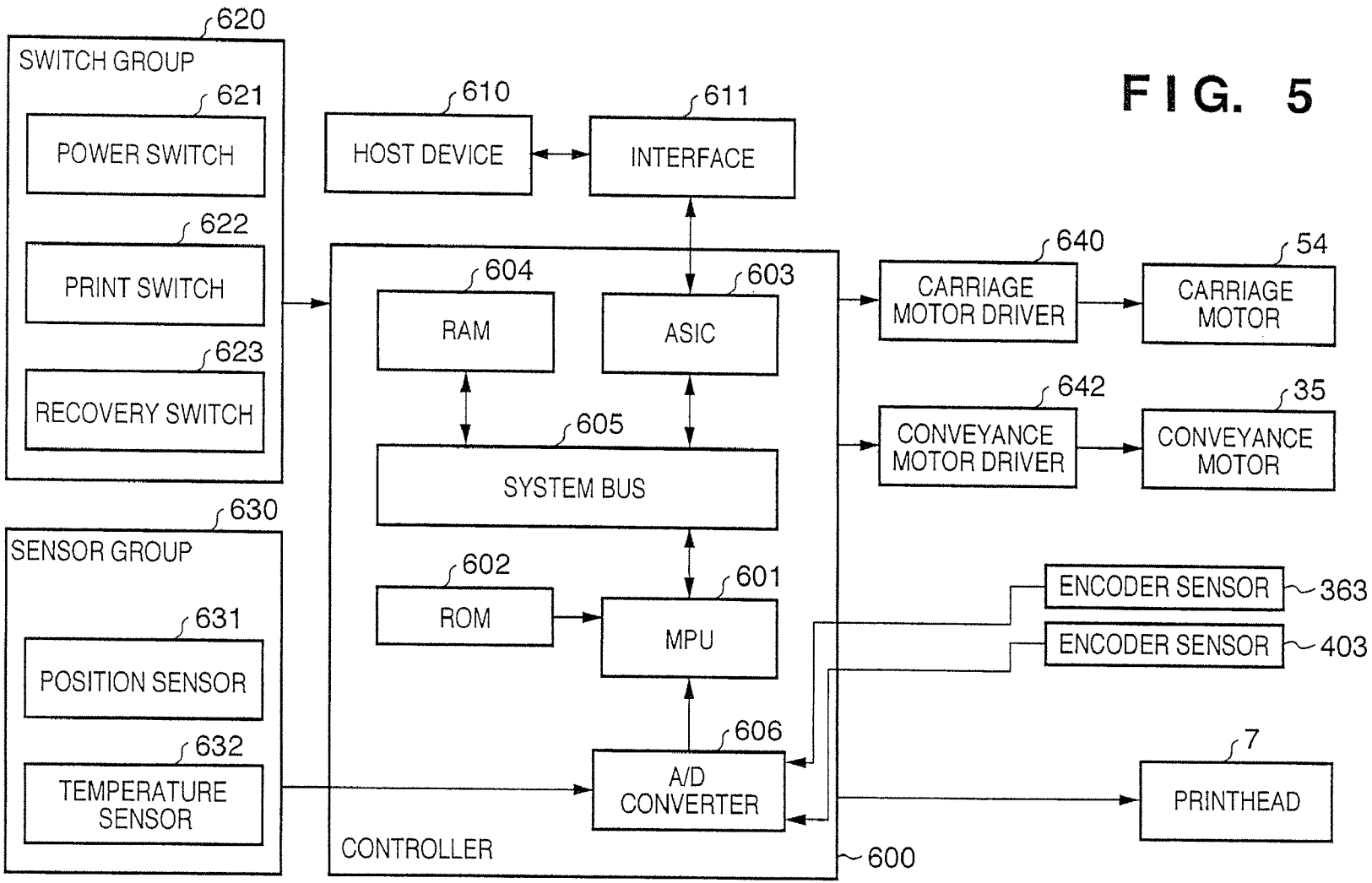
FIG. 5 is a block diagram showing the control arrangement of the printing apparatus shown in FIGS. 1 to 4.

FIG. 5 is a block diagram showing the control arrangement of the printing apparatus shown in FIGS. 1 to 4.

As shown in FIG. 5, a controller 600 has an MPU 601, ROM 602, ASIC (Application Specific Integrated Circuit) 603, RAM 604, and A/D converter 606. The ROM 602 stores programs corresponding to control sequences to be described later, necessary tables, and other fixed data. The ASIC 603 generates control signals to control the carriage motor 54, conveyance motor 35, and printhead 7. The RAM 604 has, e.g., an image data rasterization area and a work area for program execution. The MPU 601, ASIC 603, and RAM 604 connect to each other via a system bus 605 to exchange data. The A/D converter 606 receives analog signals from a sensor group to be described below, A/D-converts them, and supplies the A/D converted digital signals to the MPU 601. Note that when printing an adjustment pattern, the ASIC 603 processes data read from the ROM 602, and transfers the processed data to the printhead.

Referring to FIG. 5, a computer (or a reader for image reading or a digital camera) 610 serving as an image data supply source is generically called a host device. The host device 610 and the printing apparatus 1 exchange image data, commands, and status signals via an interface (I/F) 611. The MPU 601 not only performs printing operation based on commands and image data sent from the host apparatus 610, but also performs printing operation based on an adjustment pattern to be described later.

A switch group 620 includes a power switch 621, a print switch 622 that gives the instruction to start printing, and a recovery switch 623 that gives the instruction to activate a process (recovery process) to maintain high ink discharge performance of the printhead 7. The printing apparatus receives an operator's instruction inputs from these switches. A sensor group 630 includes a position sensor 631 such as a photocoupler to detect a home position, and a temperature sensor 632 provided at an appropriate position of the printing apparatus to detect the ambient temperature. Additionally, the A/D converter 606 receives the output from the encoder sensor 363 that detects the position of the conveyance roller 36 and the output from the encoder sensor 403 that detects the position of the discharge roller 40.

A carriage motor driver 640 drives the carriage motor 54 to reciprocally scan the carriage 50. A conveyance motor driver 642 drives the conveyance motor 35 to convey a printing medium.

In print scan of the printhead 7, the ASIC 603 transfers the drive data (DATA) of printing elements (discharge heaters) to the printhead while directly accessing a storage area of the RAM 604.

In the arrangement shown in FIGS. 1 to 4, the ink cartridges 71 and the printhead 7 are separable. They may integrate and form an exchangeable head cartridge instead.

An example will be described next in detail, in which printing medium conveyance control is performed by simultaneously inputting the outputs from a plurality of encoder sensors provided on the conveyance mechanism of a printing apparatus, comparing the input results, and assuming the state of a printing medium on the basis of the comparison.

Figure 6:
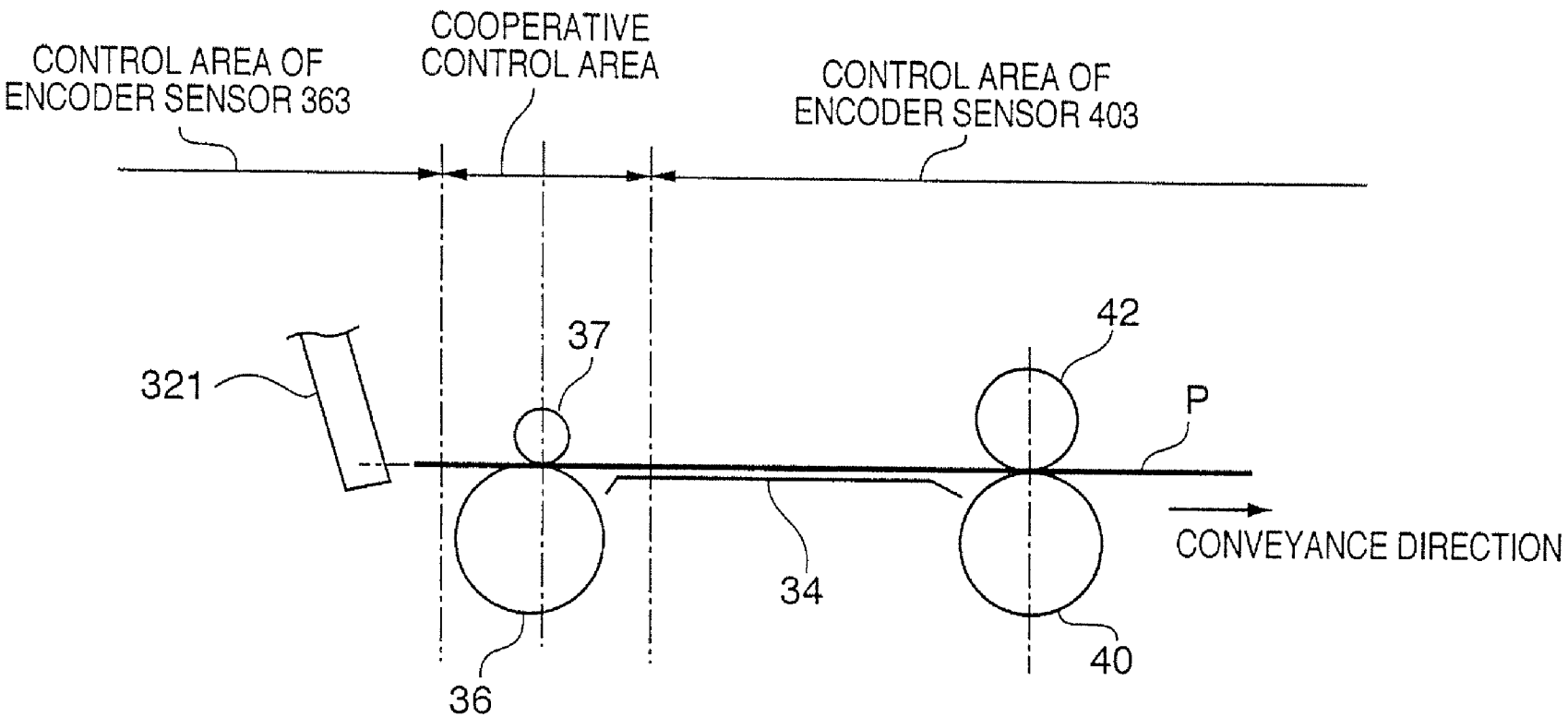
FIG. 6 is a view for explaining the control areas of a plurality of encoders.

FIG. 6 is a view for explaining the control areas of a plurality of encoders.

FIGS. 7A to 7D are views for explaining the behavior of a printing medium upon its tail end passing through a nip and conveyance amount correction.

As shown in FIG. 6, in this embodiment, control of the encoder sensors 363 and 403 is switched over according to the tail end position of a printing medium P. Alternatively, the encoder sensors 363 and 403 control conveyance of the printing medium P cooperatively.

In this embodiment, the PE sensor 32 detects the tail end position of the printing medium P. Actually, the PE sensor 32 detects the fact that the front end of the printing medium P contacts the PE sensor lever 321 provided on the pinch roller holder that holds the pinch rollers 37, or the fact that the tail end of the printing medium is in non-contact with the PE sensor lever 321.

As shown in FIG. 6, an area before the tail end of the printing medium reaches a position about 10 mm before the nip between the conveyance roller 36 and the pinch roller 37 is a control area of the encoder sensor 363. In this area, conveyance control is performed on the basis of only the output from the encoder sensor 363 to convey the printing medium by a predetermined amount and stop it at a predetermined position.

When the tail end of the printing medium P is located within the range of about 10 mm before and after the nip between the conveyance roller 36 and the pinch roller 37, conveyance control is made on the basis of the outputs from the two encoder sensors 363 and 403. This area is referred to as a cooperative control area.

In this area, the outputs from the two encoder sensors 363 and 403 are inputted. The stop position (conveyance position) of the printing medium is calculated on the basis of the two input data. The encoder sensors 363 and 403 have misalignment upon attaching these to the printing apparatus. Hence, the limiting resolution is raised by time multiplication to an extent that printing quality will not be affected, thereby correcting the positions of the encoders. In the cooperative control area, if the difference between the outputs of the two encoder sensors 363 and 403 has a predetermined amount or less, it is assumed that printing can be performed without any problem. However, for example, if the tail end of the printing medium P is located closest to the nip between the conveyance roller 36 and the pinch roller 37, the wedge effect of the nip might result in conveying the printing medium P to the discharge roller 40 downstream in the conveyance direction by an amount equal to or smaller than the backlash of a series of drive gears. In this case, the detection result of the encoder sensor 363 and that of the encoder sensor 403 (i.e., the conveyance amount of the conveyance roller 36 and that of the discharge roller 40) have a difference.

This situation and its countermeasure will be explained with reference to FIGS. 7A to 7D.

Figure 7A:
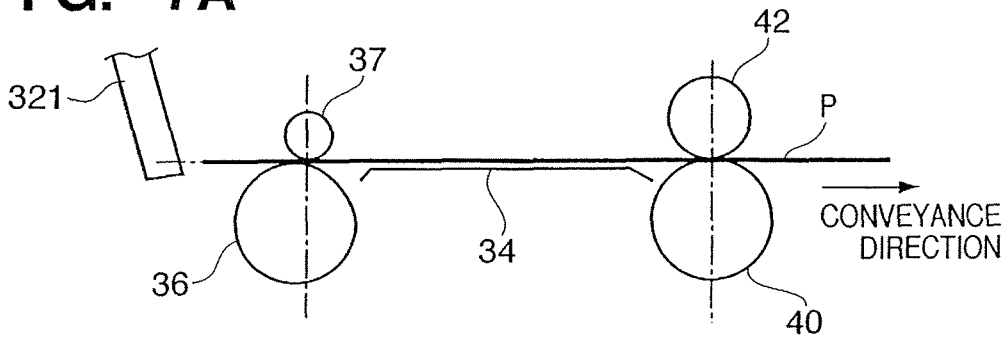
FIGS. 7A to 7D are views for explaining the behavior of a printing medium upon its tail end passing through a nip and conveyance amount correction.

FIG. 7A shows a state where the tail end of the printing medium P is reaching the cooperative control area Normally, the output difference between the encoder sensors 363 and 403 occurs due to, e.g., the eccentric amounts of the rollers, and has a predetermined amount or less.

Figure 7B:
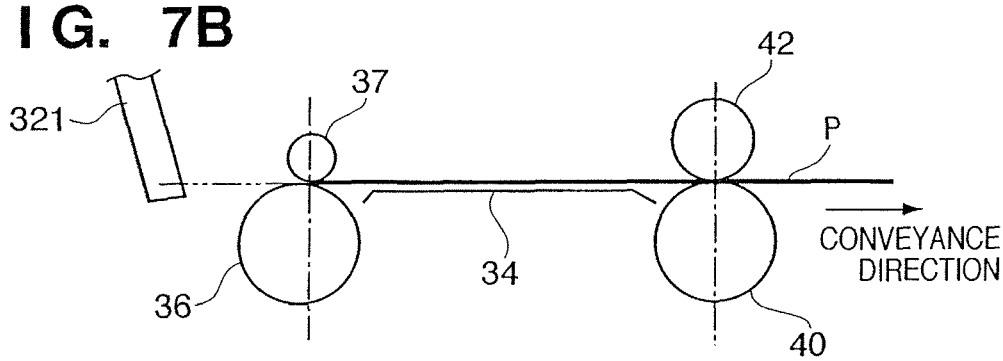
Figure 7C:
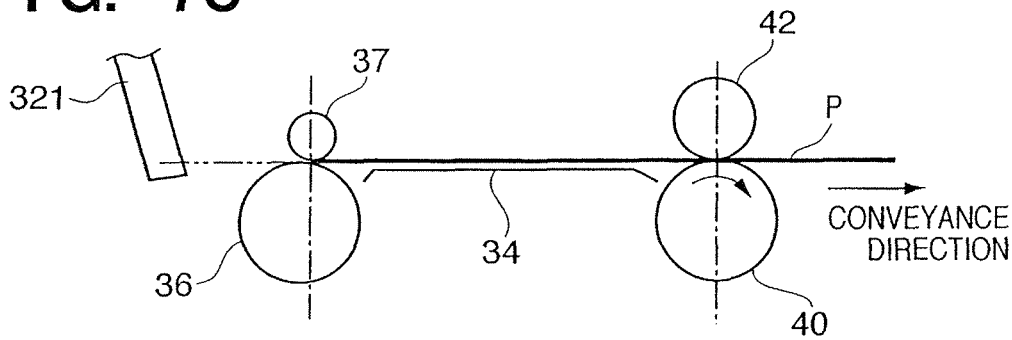

FIG. 7B shows a state where the tail end of the printing medium P is located closest to the nip between the conveyance roller 36 and the pinch roller 37. In this state, the wedge effect of the nip might result in conveying the printing medium P to the downstream discharge roller 40 by an amount corresponding to the backlash of the series of drive gears. In other words, when the tail end of the printing medium P passes through the nip between the conveyance roller 36 and the pinch roller 37, a force created by this roller pair acts on the tail end of the printing medium P, and pushes out the printing medium P towards the discharge roller 40. This movement affects the discharge roller 40. As a result, the discharge roller 40 rotates. FIG. 7C shows this state. An arrow shown in the discharge roller 40 of FIG. 7C indicates a rotation due to the backlash. Due to the backlash, the printing medium is fed, and its position shifts by an amount equal to or smaller than the backlash of the series of gears including the pulley 361, idler gear 45, and discharge roller gear 404.

The encoder sensor 403 can detect this positional shift.

Figure 7D:
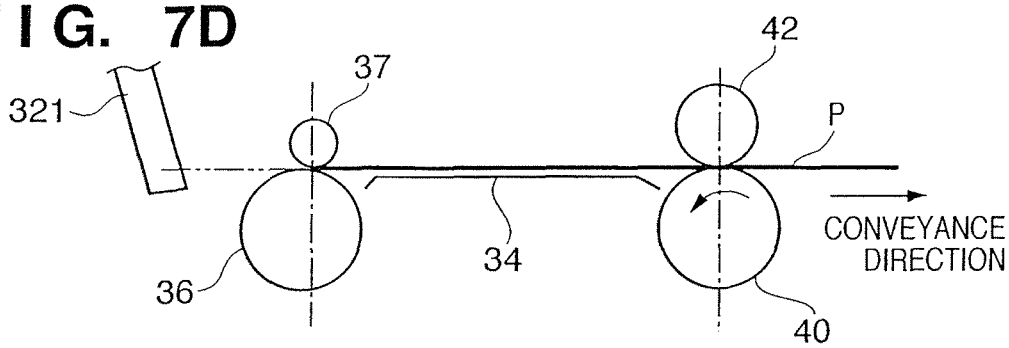

The stop position of the printing medium can be corrected by rotating the discharge roller 40 in the reverse direction, as shown in FIG. 7D.

After the tail end of the printing medium P separates from the nip between the conveyance roller 36 and the pinch roller 37 by about 10 mm, control is made in the control area of the encoder sensor 403, as shown in FIG. 6. In this area, conveyance control is performed on the basis of only the output from the encoder sensor 403 to convey the printing medium by a predetermined amount and stop it at a predetermined position.

In this embodiment, since the discharge roller 40 that directly conveys the printing medium P is controlled by using the cord wheel 402 and encoder sensor 403 directly connected to the discharge roller 40, accurate conveyance can be implemented.

According to the above-described embodiment, it is possible to perform optimum conveyance control by simultaneously inputting the outputs from two encoder sensors, comparing the input results, and assuming the conveyance state of the printing medium on the basis of the comparison result in a predetermined area on printing medium conveyance. This improves the conveyance accuracy and implements printing of an image with higher quality.

Also, appropriate conveyance control is possible even when the tail end of the printing medium P is located closest to the nip between the conveyance roller 36 and the pinch roller 37. Hence, complicated control to prevent the tail end of the printing medium P from stopping at the nip, as disclosed in Japanese Patent Publication Laid-Open No. 2002-254736, is unnecessary. Since the restrictions on use nozzles of the printhead for nozzle shift in the prior art are also eliminated, all nozzles become available, and this contributes to high-speed printing. Complicated conveyance control of the tail end portion of the printing medium need not be performed, unlike the prior art. It is, therefore, possible to print on the tail end satisfactorily.

Another Embodiment

In the above embodiment, conveyance control when the tail end of the printing medium P passes through the nip between the conveyance roller 36 and the pinch roller 37 has been described. In the following embodiment, conveyance control when a discharge roller 40 and a spur grip the front end of a printing medium P will be explained.

In this embodiment, when the discharge roller 40 and spur grip the front end of the printing medium P, position information from two encoder sensors 363 and 403 is input. A change in the behavior of the printing medium P is estimated and corrected on the basis of the position information difference.

Figure 8:
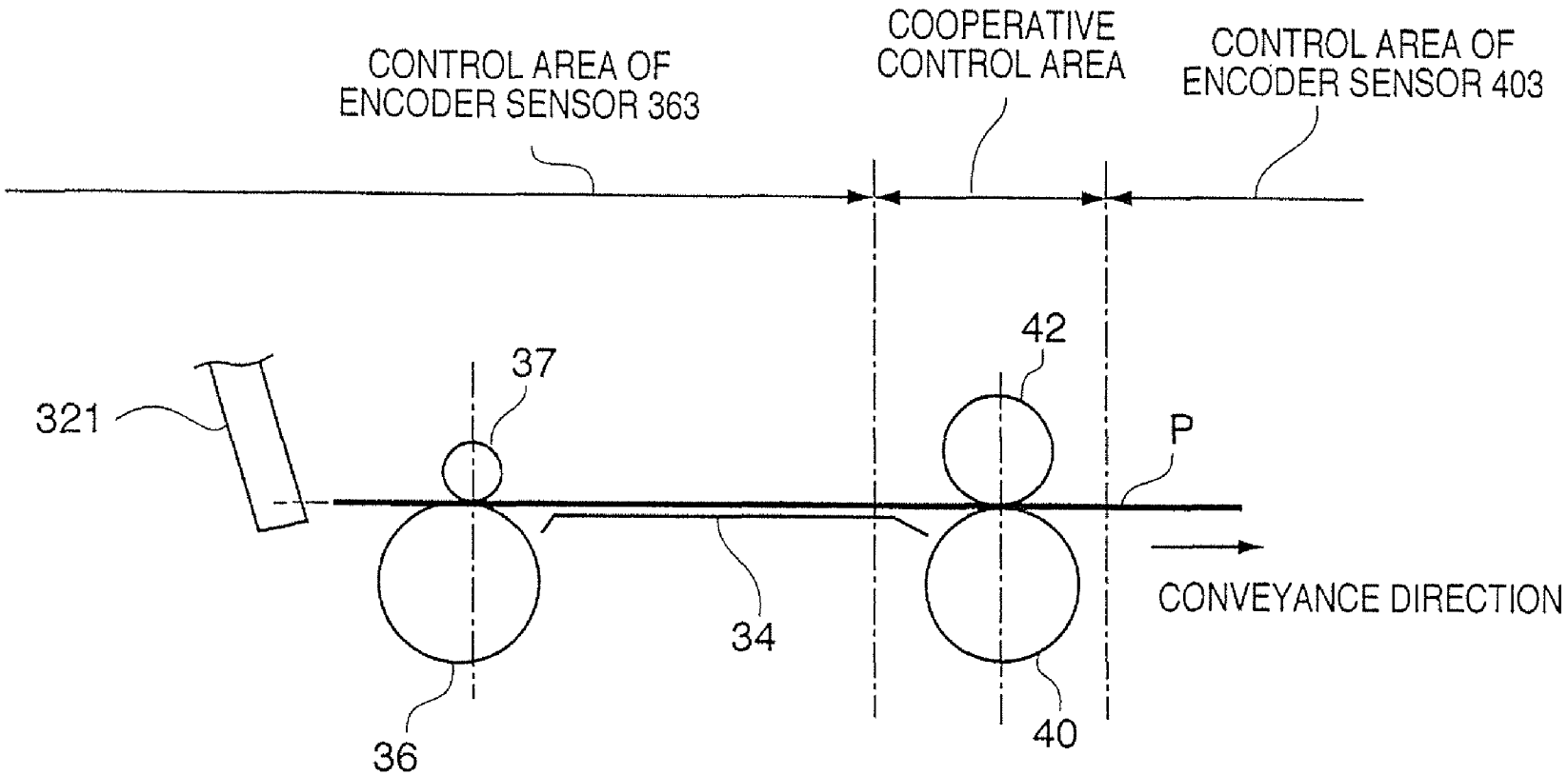
FIG. 8 is a view for explaining the control areas of a plurality of encoders according to another embodiment.

FIG. 8 is a view for explaining the control areas of a plurality of encoders according to this embodiment.

FIGS. 9A to 9D are views for explaining the behavior of a printing medium upon its front end gripped at a nip and conveyance amount correction.

As shown in FIG. 8, in this embodiment, conveyance control of the printing medium P is performed on the basis of the outputs from the encoder sensors 363 and 403, depending on the front end position of the printing medium P. In this embodiment, a PE sensor 32 detects the front end position of the printing medium P. Before the front end of the printing medium P reaches about 10 mm before the nip between the discharge roller 40 and a spur 42, control is made in the control area of the encoder sensor 363. In this area, conveyance control is performed on the basis of only the output from the encoder sensor 363 to convey the printing medium P by a predetermined amount and stop it at a predetermined position.

When the front end of the printing medium P is located within the range of about 10 mm before and after the nip between the discharge roller 40 and the spur 42, conveyance is controlled in the cooperative control area where conveyance control is performed on the basis of the outputs from the two encoder sensors 363 and 403. In this area, the outputs from the two encoder sensors 363 and 403 are inputted. The stop position (conveyance position) is calculated on the basis of the two position data. The encoder sensors 363 and 403 have misalignment upon attaching these to the printing apparatus. Hence, the limiting resolution is raised by time multiplication to an extent that printing quality will not be affected, thereby correcting the positions of the encoders.

In the cooperative control area, if the difference between the outputs of the encoder sensors 363 and 403 has a predetermined amount or less, it is assumed that printing is progressing without any problem.

However, for example, if the front end of the printing medium P reaches the nip between the discharge roller 40 and the spur 42, or the printing medium P has, e.g., a curl, the lift of the printing medium P is canceled after it is gripped at the nip between the discharge roller 40 and the spur 42. Consequently, the printing medium P is conveyed as it rotates the discharge roller 40. In this case, the output result of the encoder sensor 363 and that of the encoder sensor 403 (i.e., the conveyance amount of a conveyance roller 36 and that of the discharge roller 40) have a difference.

This situation and its countermeasure will be explained with reference to FIGS. 9A to 9D.

Figure 9A:
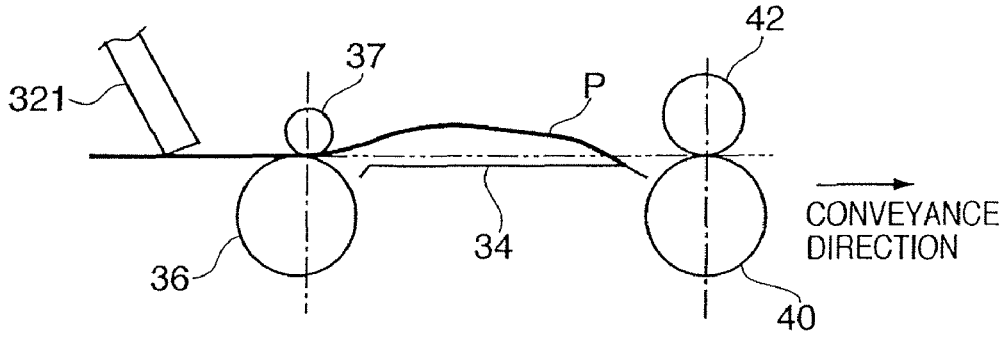
FIGS. 9A to 9D are views for explaining the behavior of a printing medium upon its front end gripped at a nip and conveyance amount correction.

FIG. 9A shows a state where the front end of the printing medium P is reaching the cooperative control area. As described in the above embodiment, normally, the output difference between the encoder sensors 363 and 403 occurs due to, e.g., the eccentric amounts of the rollers, and has a predetermined amount or less.

Figure 9B:
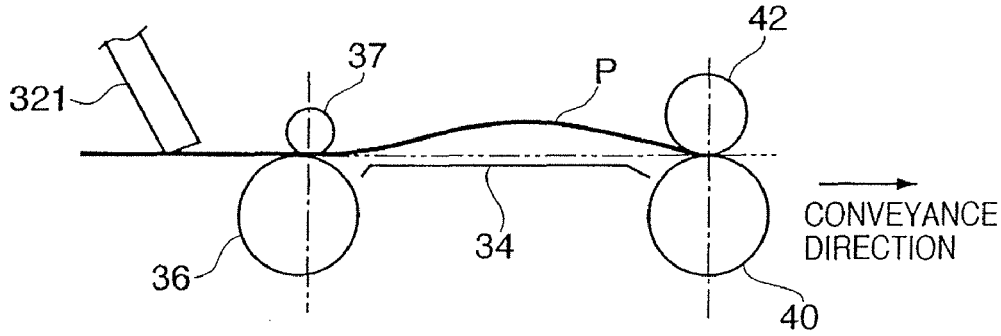
Figure 9C:
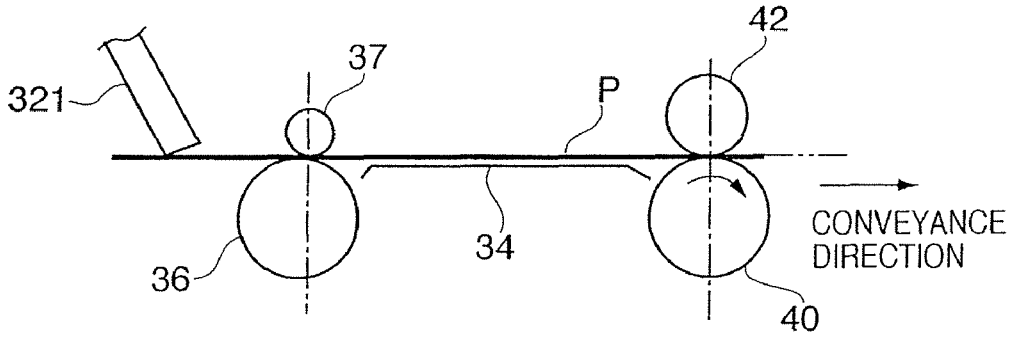

FIG. 9B shows a state where the front end of the printing medium P is located closest to the nip between the discharge roller 40 and the spur 42. If the printing medium P has a curl at its front end, the front end lifts, as shown in FIG. 9B. The printing medium is further conveyed and gripped between the discharge roller 40 and the spur 42. The spur 42 presses the printing medium P. As a result, the curl at the front end is adjusted, as shown in FIG. 9C.

Figure 10:
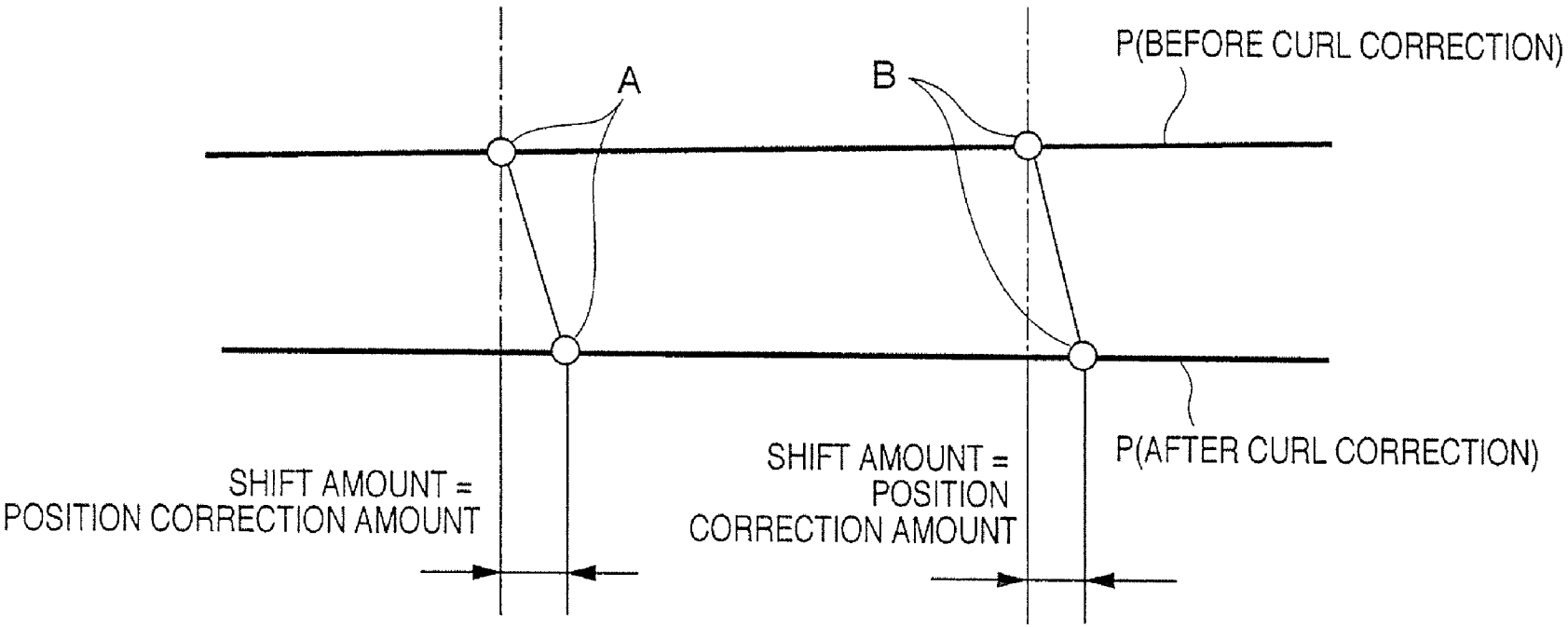
FIG. 10 is a view showing the position of a printing medium P and the landing positions of ink droplets discharged from the same nozzles of a printhead.

FIG. 10 is a view showing the position of the printing medium P and the landing positions of ink droplets discharged from the same nozzles of the printhead.

As shown in FIG. 10, when the curl at the front end of the printing medium P is adjusted, the printing medium P is overfed with respect to the nozzle position. This might result in shifting the print position and degrade the quality of the printed image. For example, ink droplet landing positions A and B shift before and after correction of the curl of the printing medium, as shown in FIG. 10.

The encoder sensor 403 can detect this shift amount.

Figure 9D:
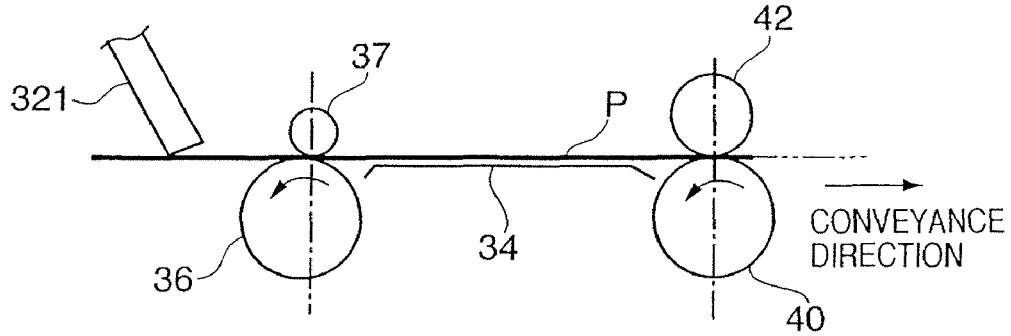

Hence, in this embodiment, the print position can be corrected by rotating the conveyance roller 36 and discharge roller 40 in the reverse direction, as shown in FIG. 9D.

After the front end of the printing medium P separates from the nip between the discharge roller 40 and the spur 42 by about 10 mm, control is made in the conveyance control area based on only the output from the encoder sensor 363. In this area, conveyance control is performed on the basis of only the output from the encoder sensor 363 to convey the printing medium P by a predetermined amount and stop it at a predetermined position.

According to the above-described embodiment, it is possible to perform optimum conveyance control by simultaneously using the outputs from a plurality of encoder sensors, comparing the output results, and estimating the state of the printing medium on the basis of the comparison result even when the front end of the printing medium reaches the nip between the discharge roller and the spur. This implements printing of an image with higher quality.

While the present invention has been described with references to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227015, filed Aug. 23, 2006, which is hereby incorporated by reference herein in its entirety.

What is claimed is:

1. A printing apparatus which includes conveyance means for conveying a printing medium, and scanning means for reciprocally moving a printhead in a direction different from a conveyance direction by the conveyance means, and causes the printhead to print on the printing medium, the apparatus comprising:

a first conveyance roller, provided in a conveyance path of the conveyance means, for conveying the printing medium;

a second conveyance roller, provided in the conveyance path of the conveyance means at a downstream side from said first conveyance roller with respect to the conveyance direction of the printing medium, for conveying the printing medium;

a first encoder sensor, provided adjacent to said first conveyance roller, for detecting a conveyance amount by said first conveyance roller;

a second encoder sensor, provided adjacent to said second conveyance roller, for detecting a conveyance amount by said second conveyance roller;

detection means for detecting a tail end of the printing medium with respect to the conveyance direction of the printing medium; and conveyance control means for controlling conveyance of the printing medium on the basis of output signals from said first encoder sensor and said second encoder sensor in a case where the tail end of the printing medium is located adjacent to said first conveyance roller, wherein said conveyance control means includes:

comparison means for comparing a conveyance amount obtained on the basis of the output signal from said first encoder sensor with a conveyance amount obtained on the basis of the output signal from said second encoder sensor; and correction means for correcting conveyance of the printing medium by rotating said second conveyance roller in a reverse direction on the basis of a comparison result from said comparison means.

2. The apparatus according to claim 1, wherein printing by the printhead is performed between said first conveyance roller and said second conveyance roller.

3. The apparatus according to claim 1, wherein said first conveyance roller and said second conveyance roller are driven by a single motor.

4. The apparatus according to claim 1, wherein adjacency of said first conveyance roller is defined as a range of approximately 10 mm along the conveyance path from a nip of said first conveyance roller.

5. A printing apparatus using a printhead to print on a printing medium, comprising:

a first conveyance roller for conveying the printing medium;

a second conveyance roller, provided at a downstream side from said first conveyance roller with respect to a conveyance direction of the printing medium, for conveying the printing medium;

a first encoder for outputting a signal according to rotation of said first conveyance roller;

a second encoder for outputting a signal according to rotation of said second conveyance roller; and conveyance control means for controlling conveyance of the printing medium on the basis of first information obtained from the signal output from said first encoder, second information obtained from the signal output from said second encoder, and a position of the printing medium on a conveyance path, wherein said conveyance control means performs conveyance control such that the printing medium is conveyed toward an upstream side of the conveyance direction of the printing medium, based on the first and second information obtained when a tail end of the printing medium has just passed through said first conveyance roller.

6. A conveyance control method of a printing apparatus which includes conveyance means for conveying a printing medium, and scanning means for reciprocally moving a printhead in a direction different from a conveyance direction by the conveyance means, and causes the printhead to print on the printing medium, the conveyance control method comprising:

a first detection step of causing a first encoder sensor to detect a conveyance amount of the printing medium by a first conveyance roller provided in a conveyance path of the conveyance means, the first encoder sensor being provided adjacent to the first conveyance roller;

a second detection step of causing a second encoder sensor to detect a conveyance amount of the printing medium by a second conveyance roller provided in the conveyance path of the conveyance means at a downstream side from the first conveyance roller with respect to the conveyance direction of the printing medium, the second encoder sensor being provided adjacent to the second conveyance roller;

a detection step of detecting a tail end of the printing medium with respect to the conveyance direction of the printing medium; and a conveyance control step of controlling conveyance of the printing medium on the basis of output signals from said first encoder sensor and said second encoder sensor in a case where the tail end of the printing is located adjacent to said first conveyance roller, wherein at said conveyance control step, a conveyance amount obtained on the basis of the output signal from said first encoder sensor is compared with a conveyance amount obtained on the basis of the output signal from said second encoder sensor, and conveyance of the printing medium is corrected by rotating said second conveyance roller in a reverse direction on the basis of the comparison result.

7. A conveyance control method applied to a printing apparatus using a printhead to print on a printing medium, comprising the steps of:

causing a first encoder to output a signal according to rotation of a first conveyance roller;

causing a second encoder to output a signal according to rotation of a second conveyance roller provided at a downstream side from the first conveyance roller with respect to a conveyance direction of the printing medium; and controlling conveyance of the printing medium on the basis of first information obtained from the signal output from the first encoder, second information obtained from the signal output from the second encoder, and a position of the printing medium on a conveyance path, wherein the conveyance control is performed such that the printing medium is conveyed toward an upstream side of the conveyance direction of the printing medium, based on the first and second information obtained when a tail end of the printing medium passes through the first conveyance roller.

* * * * *